US010466632B2

(12) United States Patent
Uehashi et al.

(10) Patent No.: US 10,466,632 B2
(45) Date of Patent: Nov. 5, 2019

(54) FIXING DEVICE AND IMAGE FORMING APPARATUS

(71) Applicant: Oki Data Corporation, Minato-ku, Tokyo (JP)

(72) Inventors: Tetsuya Uehashi, Tokyo (JP); Takaaki Furukawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/038,768

(22) Filed: Jul. 18, 2018

(65) Prior Publication Data

US 2019/0033758 A1 Jan. 31, 2019

(30) Foreign Application Priority Data

Jul. 27, 2017 (JP) ..... 2017-145550
Sep. 15, 2017 (JP) ..... 2017-177605

(51) Int. Cl.
*G03G 15/20* (2006.01)

(52) U.S. Cl.
CPC ..... *G03G 15/206* (2013.01); *G03G 15/2039* (2013.01); *G03G 15/2057* (2013.01); *G03G 2215/2022* (2013.01)

(58) Field of Classification Search
CPC ..... G03G 15/2039; G03G 15/2053; G03G 15/206; G03G 2215/2016; G03G 15/2057; G03G 2215/2022
See application file for complete search history.

(56) References Cited

U.S. PATENT DOCUMENTS

2007/0218256 A1* 9/2007 Tani ..... G03G 7/0013 428/195.1
2008/0057335 A1* 3/2008 Tamemasa ..... G03G 15/2064 428/626
2011/0013956 A1* 1/2011 Yonekawa ..... G03G 15/2057 399/333
2015/0168880 A1* 6/2015 Jota ..... G03G 15/2053 399/333
2016/0062280 A1* 3/2016 Kinuta ..... G03G 15/206 399/333
2016/0320730 A1* 11/2016 Uehashi ..... G03G 15/2053

FOREIGN PATENT DOCUMENTS

JP 2013-250393 A 12/2013

* cited by examiner

*Primary Examiner* — Sophia S Chen
(74) *Attorney, Agent, or Firm* — Panitch Schwarze Belisario & Nadel LLP

(57) ABSTRACT

A fixing device includes a belt member. The belt member includes a first insulating layer, an electrically-conductive layer, and a second insulating layer in order. The following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts.

13 Claims, 6 Drawing Sheets

FIXING DEVICE AND IMAGE FORMING APPARATUS

CROSS REFERENCE TO RELATED APPLICATIONS

The present application claims priority from Japanese Patent Applications No. 2017-145550 filed on Jul. 27, 2017, and No. 2017-177605 filed on Sep. 15, 2017, the entire contents of each which are hereby incorporated by reference.

BACKGROUND

The technology relates to a fixing device and an image forming apparatus having the fixing device.

An image forming apparatus having a fixing device that uses a belt to fix a developer image on a medium has been proposed. For example, one such device is disclosed in Japanese Unexamined Patent Application Publication No. 2013-250393. Such a fixing device may detect temperature of a belt and maintain the belt to have predetermined temperature.

SUMMARY

An image forming apparatus having a fixing device that uses a belt to fix a developer image on a medium may form an image with quality influenced by frictional electrification occurring at the belt of the fixing device in some cases.

It is desirable to provide a fixing device that is suitable for forming higher quality image and an image forming apparatus having the fixing device.

According to one embodiment of the technology, there is provided a fixing device that includes a belt member. The belt member includes a first insulating layer, an electrically-conductive layer, and a second insulating layer in order. The following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts.

According to one embodiment of the technology, there is provided an image forming apparatus that includes a fixing device. The fixing device includes a belt member. The belt member includes a first insulating layer, an electrically-conductive layer, and a second insulating layer in order. The following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts.

DETAILED DESCRIPTION

Some example embodiments of the technology are described below in detail with reference to the accompanying drawings. It is to be noted that the description below refers to mere specific examples of the technology, and the technology is therefore not limited thereto. Further, the technology is not limited to factors such as arrangements, dimensions, and dimension ratios of components illustrated in the respective drawings. The elements in the following example embodiments which are not recited in a most-generic independent claim of the technology are optional and may be provided on an as-needed basis.

[1. Example Embodiment]

[Configuration Example]

Figure 1:
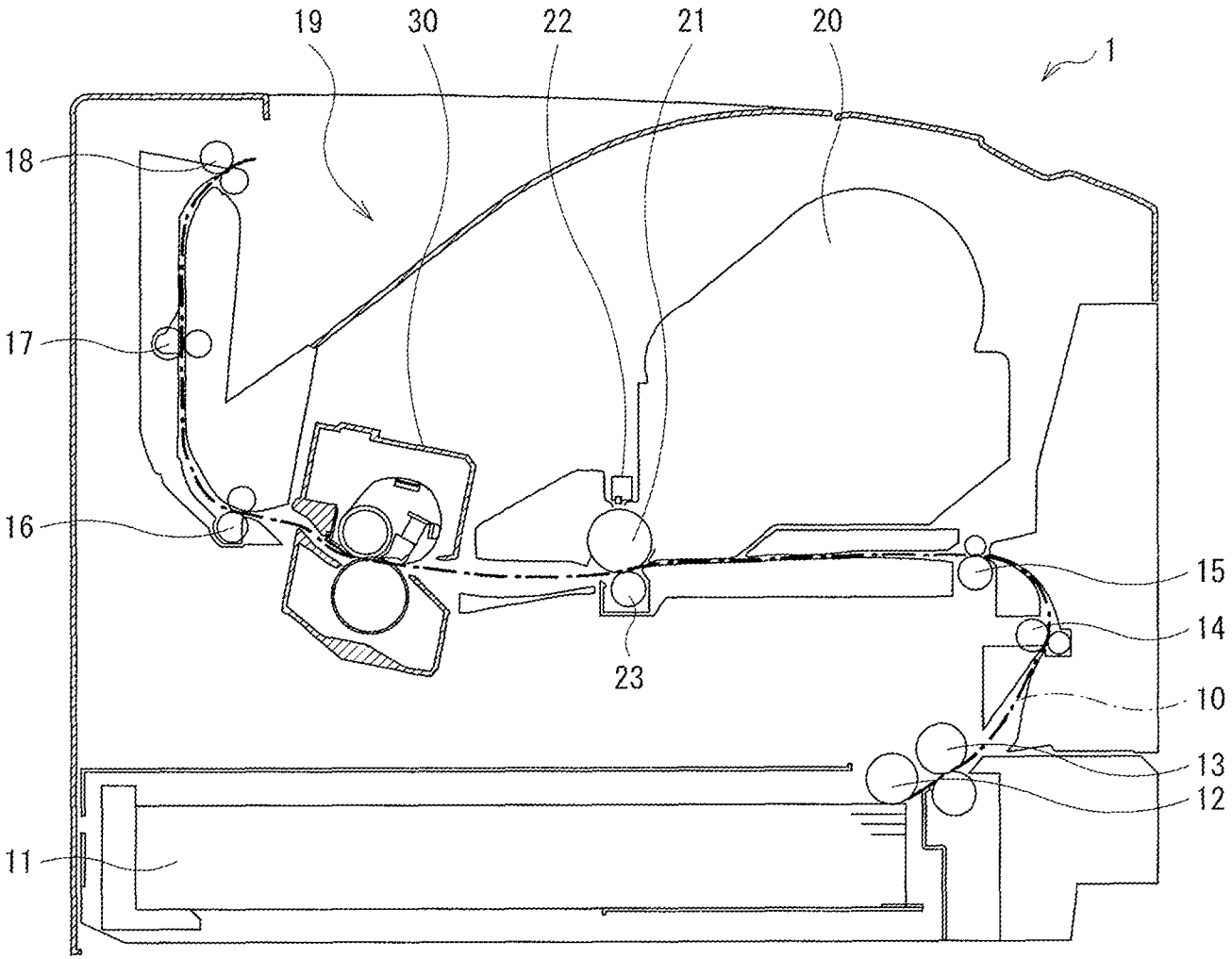
FIG. 1 is a schematic diagram illustrating a configuration example of an image forming apparatus according to an example embodiment.

FIG. 1 illustrates a configuration example of an image forming apparatus (image forming apparatus 1) according to an example embodiment of the technology. The image forming apparatus 1 may be an electrographic printer that forms an image, such as a color image, on a medium PM. The medium PM may be, for example, plain paper, and the medium PM may also be called a "print medium", a "recording medium", or a "transfer material".

The image forming apparatus 1 may include a medium tray 11, a pickup roller 12, a separating roller 13, a registration roller 14, a conveying roller 15, an image drum (ID) unit 20, an exposure head 22 and a transferring roller 23, a fixing section 30, a conveying roller 16, a conveying roller 17, and a discharging roller 18. These members may be disposed in order from the upstream to the downstream along a conveyance path 10 along which the medium PM is conveyed.

The medium tray 11 may be a container that contains the medium PM and may be, for example, detachably provided at a lower part of the image forming apparatus 1. The pickup roller 12 may pick up the medium PM contained in the medium tray 11, one by one, from the uppermost sheet and may send the picked-up medium PM to the conveyance path 10. The separating roller 13 may be a pair of rollers disposed to have the conveyance path 10 therebetween and may send one by one the medium PM, which is picked up by the pickup roller 12, to the conveyance path 10. The registration roller 14 may be a pair of rollers disposed to have the conveyance path 10 therebetween and may convey the medium PM in accordance with the timing of image formation by the ID unit 20, while correcting skew of the medium PM passing through the conveyance path 10. The conveying roller 15 may be a pair of rollers disposed to have the conveyance path 10 therebetween and may convey the medium PM along the conveyance path 10.

The ID unit 20 may form a toner image. The ID unit 20 may have a photoreceptor 21. The photoreceptor 21 may hold an electrostatic latent image on its surface at a surface layer part. The exposure head 22 may perform exposure on the photoreceptor 21 of the ID unit 20 and may include, for example, multiple light emitting diode (LED) elements. On the photoreceptor 21 subjected to the exposure by the exposure head 22, an electrostatic latent image may be formed. Thereafter, a toner may be fed on the photoreceptor 21, and a toner image may be thereby formed. The transferring roller 23 may electrostatically transfer the toner image, which is formed by the ID unit 20, onto a target surface of the medium PM.

The fixing section 30 may apply heat and pressure to the medium PM and thereby fix the transferred toner image to the medium PM. The fixing section 30 may be replaceable. The fixing section 30 may correspond to a "fixing device" in one specific but non-limiting embodiment of the technology.

Figure 2:
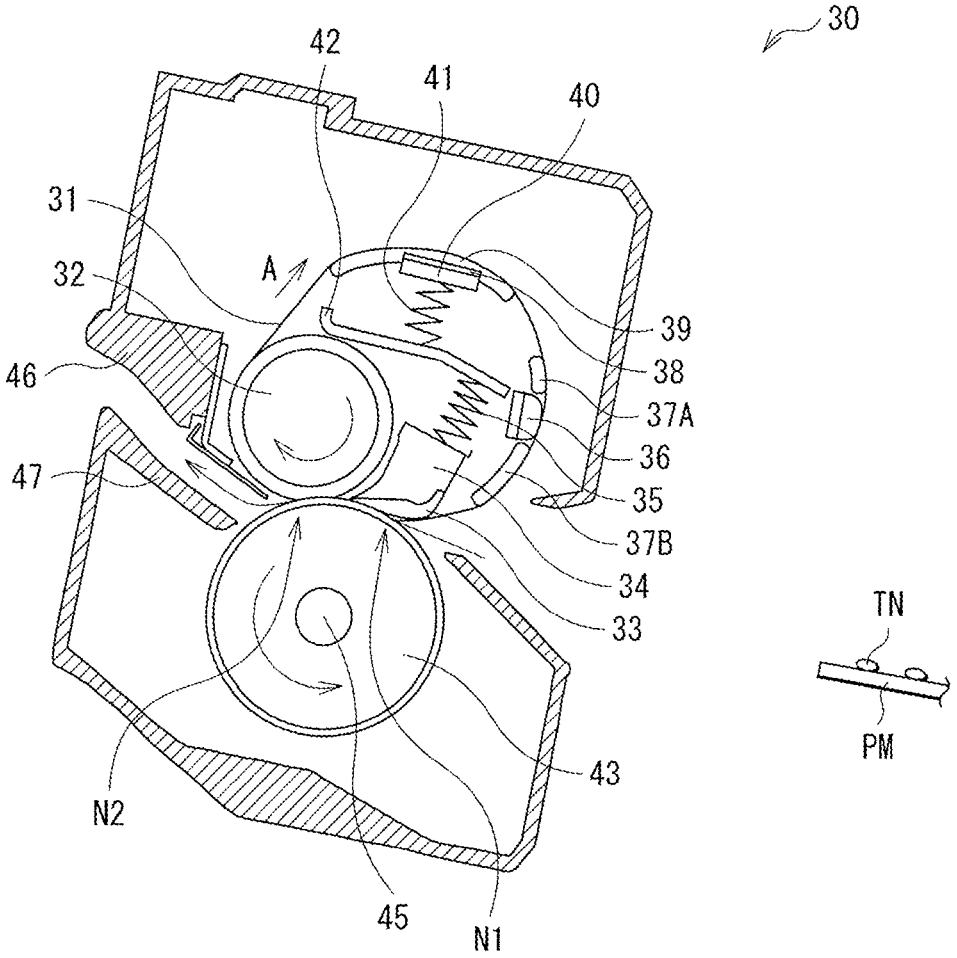
FIG. 2 is a schematic diagram illustrating a configuration example of a fixing section illustrated in FIG. 1.

FIG. 2 illustrates a configuration example of the fixing section 30. The fixing section 30 may have a fixing belt 31, a fixing roller 32, a pressure-applying pad 33, a pad support 34, a coil spring 35, a temperature sensor 36, a heater 38, a heat transmitting member 39, a heater support 40, a coil spring 41, and a pressure-applying roller 43.

Figure 3:
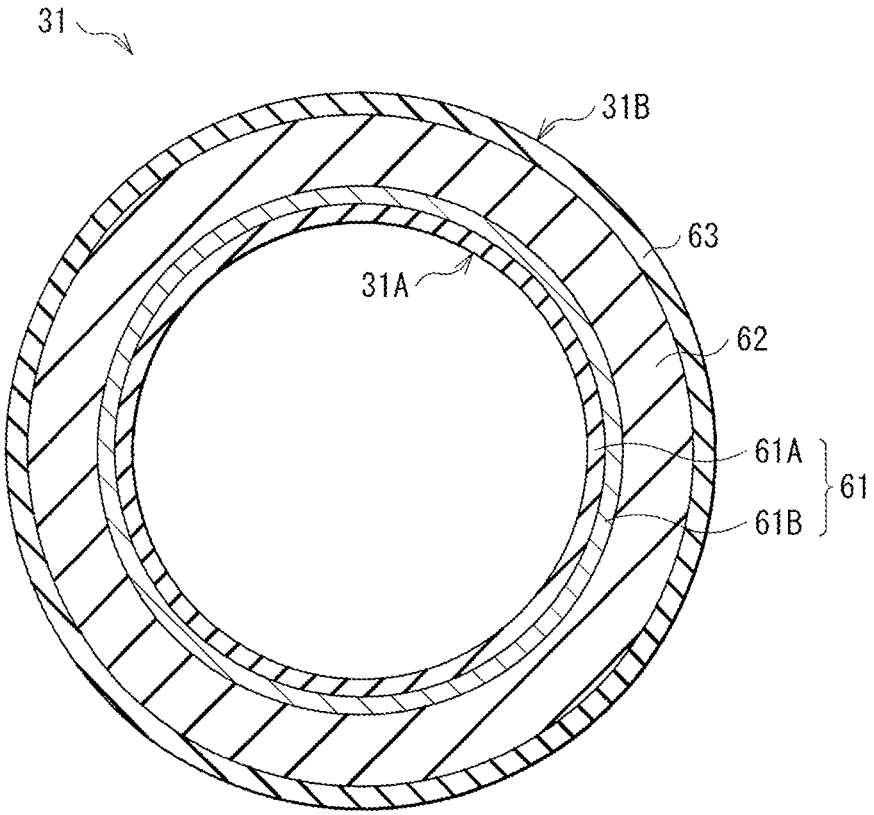
FIG. 3 is a cross-sectional view of a configuration example of a fixing belt illustrated in FIG. 2.

The fixing belt 31 may be an endless elastic belt and may lie on the fixing roller 32, the pressure-applying pad 33, guides 37A and 37B, and the heat transmitting member 39 while being stretched. The fixing belt 31 may be rotatable, for example, in a direction indicated by an arrow A (refer to FIG. 2) around a rotational axis along a direction perpendicular to the conveying direction of the medium PM, which is a direction orthogonal to the paper plane of FIG. 1 or 2. The fixing belt 31 may be an endless belt with a tubular shape or a cylindrical shape. FIG. 3 illustrates a cross section of the structure of the fixing belt 31. As illustrated in FIG. 3, the fixing belt 31 may have an inner circumferential surface 31A and an outer circumferential surface 31B. The fixing belt 31 may have, for example, a base 61, an elastic layer 62 provided on the base 61, and a releasing layer 63 provided on the elastic layer 62, in this order from the inner circumferential surface 31A side. The base 61 may have a bilayer structure with an insulating layer 61A and an electrically-conductive layer 61B. The insulating layer 61A may be exposed to the inner circumferential surface 31A. The electrically-conductive layer 61B may be provided between the insulating layer 61A and the elastic layer 62. The inner circumferential surface 31A may be brought into contact with the heat transmitting member 39. Thus, the insulating layer 61A may be positioned between the electrically-conductive layer 61B and the heat transmitting member 39. The elastic layer 62 may be positioned on side opposite to the insulating layer 61A of the electrically-conductive layer 61B. The releasing layer 63 may be positioned on side opposite to the electrically-conductive layer 61B of the elastic layer 62.

The fixing belt 31 may correspond to a "belt member" in one specific but non-limiting embodiment of the technology. The insulating layer 61A, the electrically-conductive layer 61B, and the elastic layer 62 may respectively correspond to a "first insulating layer", an "electrically-conductive layer", and a "second insulating layer" in one specific but non-limiting embodiment of the technology.

The base 61 may include a material with high heat resistance and high strength. The insulating layer 61A may include resin with high heat resistance and high strength, such as polyimide (PI), polyphenylene sulphide (PPS), or polyetheretherketone (PEEK). This resin may be used as a base material corresponding to a "base material" in one specific but non-limiting embodiment of the technology. The electrically-conductive layer 61B may include a material in which an electrically-conductive filler is uniformly dispersed in the resin used as the base material. Examples suitably used for the electrically-conductive filler may include metal such as Ag, Cu. Al, Mg, or Ni, graphite, or a carbon compound such as carbon black, carbon nanofiber, or carbon nanotube. The electrically-conductive filler including such a material may correspond to an "electrically-conductive agent" in one specific but non-limiting embodiment of the technology.

In one example, the insulating layer 61A may have a thickness of about 10 μm or greater and about 100 μm or less or may have a thickness of about 20 μm or greater and about 60 μm or less. The insulating layer 61A having a thickness of about 10 μm or greater sufficiently withstand wear by sliding friction between the fixing belt 31 and other members accompanying rotational movement of the fixing belt 31. If the insulating layer 61A is worn, dielectric breakdown may occur at the insulating layer 61A, and the electrically-conductive layer 61B may be exposed. In this case, for example, the temperature sensor 36 and the electrically-conductive layer 61B may be electrically connected with each other, and thus, a frame ground (FG) and a first potential side may be undesirably connected electrically with each other. On the other hand, if the insulating layer 61A has a thickness of about 100 μm or less, heat is transmitted in a shorter time from the heater 38 through the heat transmitting member 39 in contact with the inner circumferential surface 31A, thereby preventing increase in starting time for starting the fixing section 30.

In one example, the electrically-conductive layer 61B may have volume resistivity of about $10^7\Omega\cdot$cm or greater and about $10^{13.5}\Omega\cdot$cm or less or may have volume resistivity of about $10^8\Omega\cdot$cm or greater and about $10^{11}\Omega\cdot$cm or less. If the electrically-conductive layer 61B has volume resistivity of about $10^7\Omega\cdot$cm or greater, dielectric breakdown at the insulating layer 61A, that is, short-circuit between the frame ground (FG) and the first potential side is reliably avoided. Further, if the electrically-conductive layer 61B has volume resistivity of about $10^{13}\Omega\cdot$cm or less, as described later, frictional electrification between the heat transmitting member 39 and the fixing belt 31 and frictional electrification between the temperature sensor 36 and the fixing belt 31 are sufficiently reduced. The volume resistivity described herein may be a value measured by a method in conformity to JIS K 6911. For example, the volume resistivity may be obtained by measurement performed after a voltage of 100V is applied to the electrically-conductive layer 61B for 10 seconds by using a device named "Hiresta UP MCP HT450", available from Mitsubishi Chemical Analytech Co., Ltd, Kanagawa, Japan.

Further, the electrically-conductive layer 61B may satisfy the following conditional expression (1), $$9.11\Omega \leq \log RV1 \leq 13.34\Omega \quad (1)$$

where the symbol "RV1" represents a volume resistance of the electrically-conductive layer 61B on a condition that an applied voltage is 100 V, and the value of "RV1" may be measured by a method in conformity to JIS K 6911.

In one example, the fixing belt 31 as a whole may satisfy the following conditional expression (2), $$12.61\Omega \leq \log RV2 \leq 13.20\Omega \quad (2)$$

where the symbol "RV2" represents a volume resistance of the fixing belt 31 on a condition that an applied voltage is 1000 V, and the value of "RV2" may be measured by a method in conformity to JIS K 6911.

If log RV1 is 13.34Ω or less, or log RV2 is 13.20Ω or less, accumulation of electric charges to the fixing belt 31 is reduced, thereby enabling avoiding adhesion to the fixing belt 31 of electrically-charged powder of the toner TN, the medium PM, or of other materials. Further, if log RV1 is 9.11Ω or greater, or log RV2 is 12.61Ω or greater, adhesion to the pressure-applying roller 43 of powder of the toner TN, the medium PM, or of other materials is avoided.

The elastic layer 62 may include a material with high heat resistance and high elasticity, for example, heat-resistant elastomer such as silicone rubber or fluororesin. In one example, the elastic layer 62 may have a thickness of about 100 μm or greater and about 300 μm or less in a case of including silicone rubber, for example.

The releasing layer 63 may include fluororesin such as polytetrafluoroethylene (PTFE), perfluoroalkoxy alkane (PFA), or perfluoroethylene propylene copolymer (FEP). The releasing layer 63 may have a thickness of about 5 μm or greater and about 50 μm or less, for example. The fixing belt 31 may be so stretched as to have the releasing layer 63 exposed to the outer circumferential surface 31B.

The fixing roller 32 may rotate the fixing belt 31 in a circulating manner and may provide a nip N2 between the pressure-applying roller 43 and the fixing roller 32. The fixing roller 32 may have a core metal part and an elastic layer that covers around the core metal part. The core metal part may have a pipe shape or a shaft shape, for example. The core metal part may include a material such as aluminum, iron, or stainless steel. The elastic layer may include a rubber material with high heat resistance, such as a silicone rubber sponge or fluororubber. The configuration of the fixing roller 32 may not be limited to the above configuration. In one example, the fixing roller 32 may further have a releasing layer that covers around the elastic layer in addition to the core metal part and the elastic layer. In this example embodiment, the fixing roller 32 may rotate in a clockwise direction by power transmitted from a fixing motor 44, which is described later. The fixing roller 32 may be disposed in contact with the inner circumferential surface 31A of the fixing belt 31. This configuration allows the fixing roller 32 to rotate the fixing belt 31 in the arrow A direction in FIG. 2 in a circulating manner.

The pressure-applying pad 33 may provide a nip N1 between the pressure-applying roller 43 and the pressure-applying pad 33. The pressure-applying pad 33 may include a rubber material, for example. The pad support 34 may support the pressure-applying pad 33. The coil spring 35 may be interposed between the support 42 and the pad support 34, and urge the pressure-applying pad 33 in a direction away from the support 42. This configuration makes the pressure-applying pad 33 be in contact with the inner circumferential surface 31A of the fixing belt 31 and be so pressed against the pressure-applying roller 43 as to be in contact with the pressure-applying roller 43 while having the fixing belt 31 between the pressure-applying pad 33 and the pressure-applying roller 43. Thus, the pressure-applying pad 33 may provide the nip N between the pressure-applying roller 43 and the pressure-applying pad 33.

The temperature sensor 36 may detect the temperature of the fixing belt 31 while being in contact with the inner circumferential surface 31A of the fixing belt 31 and sliding on the inner circumferential surface 31A of the fixing belt 31. The temperature sensor 36 may include a thermistor, for example. The temperature sensor 36 may correspond to a "temperature detector" in one specific but non-limiting embodiment of the technology.

The heater 38 may be a heat source that heats the fixing belt 31 and may include, for example, a resistance wire as a heat generator. The heat transmitting member 39 may transmit the heat generated by the heater 38, to the fixing belt 31. The heater 38 may be so controlled by a heater controller 581 of a fixation controller 58, as to cause the fixing belt 31 to have a predetermined temperature. The temperature of the fixing belt 31 may be detected by the temperature sensor 36. Details of the heater controller 581 and the fixation controller 58 will be described later. The heater support 40 may support the heater 38. The coil spring 41 may be interposed between the support 42 and the heater support 40 and urge the heater 38 and the heat transmitting member 39 in a direction away from the support 42. This configuration makes the heat transmitting member 39 be in contact with the inner circumferential surface 31A of the fixing belt 31 and outwardly push the fixing belt 31, thereby allowing the fixing belt 31 to be stretched. The heater 38 may correspond to a "heat generating member" in one specific but non-limiting embodiment of the technology. The heat transmitting member 39 may correspond to a "heat transmitting member" in one specific but non-limiting embodiment of the technology.

The pressure-applying roller 43 may provide the nip N1 between the pressure-applying pad 33 and the pressure-applying roller 43 and may also provide the nip N2 between the fixing roller 32 and the pressure-applying roller 43. The pressure-applying roller 43 may be allowed to be in contact with the outer circumferential surface 31B of the fixing belt 31. The pressure-applying roller 43 may correspond to a "pressure-applying member" in one specific but non-limiting embodiment of the technology. The pressure-applying roller 43 may have a configuration similar to that of the fixing roller 32, for example. In this example embodiment, the pressure-applying roller 43 may rotate in a counterclockwise direction following the rotation in the circulating manner of the fixing belt 31. In one example, the pressure-applying roller 43 may include a halogen heater 45 built therein that increases the temperature of the surface of the pressure-applying roller 43 and thereby accelerates increase in temperature of the fixing belt 31, as necessary.

With this configuration, when the medium PM having the toner image formed thereon is fed to the nips N1 and N2, the toner TN (refer to FIG. 2) on the medium PM is heated, melted, and applied with pressure. As a result, the toner image is fixed on the medium PM.

The conveying roller 16 (refer to FIG. 1) may be a pair of rollers disposed to have the conveyance path 10 therebetween and may convey the medium PM, which is fed from the fixing section 30, along the conveyance path 10. The conveying roller 17 may be a pair of rollers disposed to have the conveyance path 10 therebetween and may convey the medium PM along the conveyance path 10. The discharging roller 18 may be a pair of rollers disposed to have the conveyance path 10 therebetween and may deliver the medium PM to a discharge tray 19.

The fixing section 30 may also have a separator 46 and a guide 47 that are provided downstream of the nip N2. The separator 46 and the guide 47 may be separately disposed and face each other. The separator 46 may separate the medium PM from the fixing belt 31 and thereby prevent the medium PM from being entangled in the fixing belt 31 after the medium PM passes through the nips N1 and N2. The guide 47 may smoothly guide the medium PM to the conveying roller 16 after the medium PM passes through the nips N1 and N2.

Figure 4:
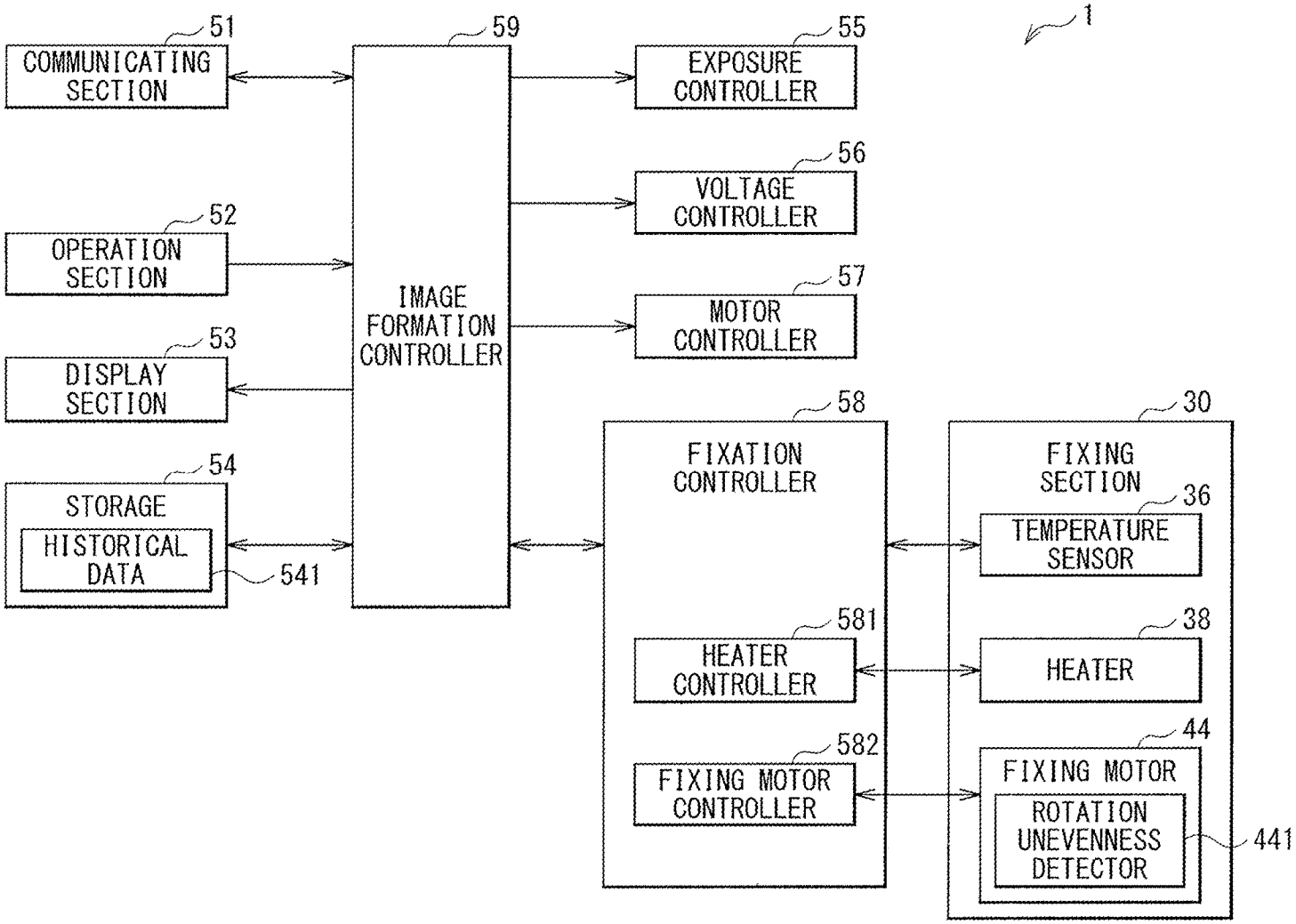
FIG. 4 is a block diagram illustrating an example of a control mechanism of the image forming apparatus of one example embodiment.

FIG. 4 illustrates an example of a control mechanism of the image forming apparatus 1. The image forming apparatus 1 may include a communicating section 51, an operation section 52, a display section 53, a storage 54, an exposure controller 55, a voltage controller 56, a motor controller 57, a fixation controller 58, and an image formation controller 59.

The communicating section 51 may make communication, for example, by using a universal serial bus (USB) or a local area network (LAN). In one example, the communicating section 51 may receive print data DP sent from a host computer. The operation section 52 may receive an operation performed by a user and may have various kinds of buttons, for example. The display section 53 may display the operation condition of the image forming apparatus 1 and may include, for example, a liquid crystal display and various kinds of indicators.

The storage 54 may hold, for example, the print data DP, various kinds of setting information of the image forming apparatus 1, and other information. The storage 54 may also hold historical data 541. The historical data 541 may be recorded data of operation history of the image forming apparatus 1. For example, the historical data 541 may include information such as the cumulative printing number of sheets printed by the image forming apparatus 1 and the printing number of sheets printed by using a current fixing section 30. The printing number of sheets may be reset in response to replacement of the fixing section 30.

The exposure controller 55 may control the operation of the exposure head 22 on the basis of the instruction from the image formation controller 59.

The voltage controller 56 may generate various voltages that are used in the image forming apparatus 1, on the basis of the instruction from the image formation controller 59. For example, the voltage controller 56 may generate an electrically-charging voltage and a developing voltage that are used in the ID unit 20 and may also generate a transferring voltage to be applied to the transferring roller 23.

The motor controller 57 may control the operation of a motor such as a main motor used in the image forming apparatus 1, on the basis of the instruction from the image formation controller 59.

The fixing section 30 may have a fixing motor 44. The fixing motor 44 may supply power to the fixing roller 32. The fixing motor 44 may have a rotation unevenness detector 441. The rotation unevenness detector 441 may generate an error signal in a case where rotation unevenness occurs in the fixing motor 44.

The fixation controller 58 may control the operation of the fixing section 30 on the basis of the instruction from the image formation controller 59 and the detection result from the temperature sensor 36 of the fixing section 30. The fixation controller 58 may have a heater controller 581 and a fixing motor controller 582. The heater controller 581 may control the operation of the heater 38 of the fixing section 30. The fixing motor controller 582 may control the operation of the fixing motor 44. Moreover, the fixation controller 58 may supply an error signal to the image formation controller 59 in a case of receiving the error signal from the rotation unevenness detector 441 of the fixing motor 44.

The image formation controller 59 may control the operation of each of these blocks to control the operation of the image forming apparatus 1 as a whole. For example, in a case where the communicating section 51 of the image forming apparatus 1 receives the print data DP, the image formation controller 59 may instruct, on the basis of the print data DP, the exposure controller 55, the voltage controller 56, the motor controller 57, and the fixation controller 58 to perform respective operation for forming an image. In a case of receiving an error signal from the fixation controller 58, the image formation controller 59 may stop the currently-executed process and may make the display section 53 display an error indication. The functions of the image formation controller 59 may be implemented, for example, by hardware or may be implemented by software.

Prior to an image formation operation, the image forming apparatus 1 may first perform a warm-up operation to cause the temperature of the fixing belt 31 to reach a predetermined target temperature. Thereafter, the image forming apparatus 1 may perform the image formation operation. The predetermined target temperature may be, for example, about 170 degrees Celsius.

[Operation and Workings]

Next, operation and workings of the image forming apparatus 1 of the example embodiment will be described.

[Outline of General Operation]

First, an outline of the general operation of the image forming apparatus 1 is described with reference to FIGS. 1 and 4. When the communicating section 51 of the image forming apparatus 1 receives the print data DP, the image formation controller 59 may perform a process on the basis of the print data DP. Further, the image formation controller 59 may control the operation of each of the exposure controller 55, the voltage controller 56, the motor controller 57, and the fixation controller 58 on the basis of the processing result. In the warm-up operation, the fixation controller 58 may control the operation of the fixing section 30 to cause the temperature of the fixing belt 31 to reach a predetermined target temperature. In the image formation operation, the exposure controller 55 may control light emission operation of the exposure head 22, and the voltage controller 56 may generate various voltages such as the electrically-charging voltage, a developing voltage, and a transferring voltage. Further, the motor controller 57 may control the operation of a motor such as the main motor used in the image forming apparatus 1, and the fixation controller 58 may control the operation of the fixing section 30. As a result, the medium PM supplied from the medium tray 11 may be conveyed along the conveyance path 10, a toner image generated by the ID unit 20 may be transferred onto the medium PM, and the toner image may be fixed to the medium PM by the fixing section 30. Thereafter, the medium PM having the toner image fixed thereto may be delivered to the discharge tray 19.

[Electrostatic Offset]

A phenomenon called "electrostatic offset" may occur in a typical fixing section, in which, for example, a toner TN electrostatically adheres to a surface of a fixing belt. The electrostatic offset is a phenomenon in which a portion of the toner TN held on a medium PM is electrostatically attracted to a surface of a fixing belt before the toner TN is subjected to a fixing process. This phenomenon may occur, for example, by electric charging of the medium PM itself or electric charging of a fixing belt due to friction between the fixing belt and any other member. For example, the toner TN may be negatively charge, whereas the medium PM may be positively charged to have a polarity inverse to the polarity of the toner TN. At the time this medium PM passes through a nip of a fixing section, the positive charge of the medium PM may positively charge the fixing belt. Additionally, or alternatively, friction between the fixing belt and a temperature sensor may positively charge the fixing belt. In such cases, a portion of the negatively-charged toner TN on the medium PM electrostatically flies to the surface of the fixing belt due to the positive charge of the fixing belt, in proximity to the entrance of the nip of the fixing section. As a result, strip-shaped unevenness may appear on a printed image.

[Example Workings and Example Effects]

In view of this phenomenon, in this example embodiment, the fixing belt 31 has the electrically-conductive layer 61B, the insulating layer 61A positioned between the electrically-conductive layer 61B and the heat transmitting member 39, and the elastic layer 62 positioned on side opposite to the insulating layer 61A of the electrically-conductive layer 61B. The electrically-conductive layer 61B may have volume resistivity of, for example, about $10^7 \Omega \cdot cm$ or greater and about $10^{13.5}\Omega\cdot$cm or less and has a volume resistance that satisfies the conditional expression (1). Moreover, the fixing belt 31 may have a volume resistance that satisfies the conditional expression (2). Such a configuration of the fixing belt 31 reduces generation of electric charging of the fixing belt 31 due to the friction between the heat transmitting member 39 and the insulating layer 61A of the fixing belt 31, the friction between the temperature sensor 36 and the insulating layer 61A, or any other factor. As a result, it is more difficult for the negatively-charged toner TN on the medium PM to fly to the fixing belt 31, and occurrence of the electrostatic offset is therefore suppressed, whereby a higher-quality image is fixed on the medium PM. Addition of carbon black to polyimide may decrease mechanical durability. However, in this example embodiment, since the insulating layer 61A that is to be brought into contact with the fixing roller 32 or any other member may use polyimide with no added carbon black, the insulating layer 61A reliably has sufficient mechanical durability. Accordingly, as in an existing fixing belt, the fixing belt 31 smoothly rotates in the circulating manner while being in close contact with the fixing roller 32 or any other member, without being damaged during a long period of time.

[2. Experiment Examples]

An example experiment was performed by evaluating the image forming apparatus 1 according to the above example embodiment.

[Experiment Examples 1-1 to 1-11]

The relationship between the thickness (μm) of the insulating layer 61A of the base 61 and each of the occurrence of dielectric breakdown at the insulating layer 61A and the occurrence of delay in a rise time was evaluated. The rise time is a time required to heat the outer circumferential surface 31B of the fixing belt 31 to a predetermined temperature by the heater 38. The results are illustrated in Table 1. In these experiment examples, the insulating layer 61A included polyimide and had a thickness of 5 μm or greater and 115 μm or less. The electrically-conductive layer 61B of the base 61 included polyimide containing carbon black that was dispersed as an electrically-conductive filler, and the electrically-conductive layer 61B had volume resistivity of $1.0\times10^{9}\Omega\cdot$cm. The elastic layer 62 included silicone rubber and had a thickness of 200 μm. The releasing layer 63 included PFA.

TABLE 1

| | Thickness of insulating layer [μm] | Dielectric breakdown | Delay in rise time |
|---|---|---|---|
| Experiment example 1-1 | 5 | Occurred | Not occurred |
| Experiment example 1-2 | 10 | Not occurred | Not occurred |
| Experiment example 1-3 | 15 | Not occurred | Not occurred |
| Experiment example 1-4 | 20 | Not occurred | Not occurred |
| Experiment example 1-5 | 25 | Not occurred | Not occurred |
| Experiment example 1-6 | 55 | Not occurred | Not occurred |
| Experiment example 1-7 | 60 | Not occurred | Not occurred |
| Experiment example 1-8 | 65 | Not occurred | Not occurred |
| Experiment example 1-9 | 95 | Not occurred | Not occurred |

TABLE 1-continued

| | Thickness of insulating layer [μm] | Dielectric breakdown | Delay in rise time |
|---|---|---|---|
| Experiment example 1-10 | 100 | Not occurred | Not occurred |
| Experiment example 1-11 | 115 | Not occurred | Occurred |

As illustrated in Table 1, dielectric breakdown occurred at the insulating layer 61A with a thickness of 5 μm of Experiment example 1-1. On the other hand, delay in the rise time was observed in Experiment example 1-11 having the insulating layer 61A with a thickness of 115 μm. From the results of the evaluation of Experiment examples 1-1 to 1-11, the insulating layer 61A having a thickness of 10 μm or greater and 100 μm or less has favorable characteristics.

[Experiment Examples 2-1 to 2-11]

Thereafter, the relationship between the volume resistivity ($\Omega\cdot$cm) of the electrically-conductive layer 61B of the base 61 and each of the occurrence of dielectric breakdown at the insulating layer 61A and the occurrence of electrostatic offset was evaluated. The results are illustrated in Table 2. In these experiment examples, the insulating layer 61A included polyimide and had a thickness of 30 μm. The electrically-conductive layer 61B included polyimide containing carbon black that was dispersed as an electrically-conductive filler, and the electrically-conductive layer 61B had volume resistivity of $1.0\times10^{5}\Omega\cdot$cm or greater and $1.0\times10^{14}\Omega\cdot$cm or less. The other conditions were substantially the same as those for Experiment examples 1-1 to 1-11.

TABLE 2

| | Volume resistivity of electrically-conductive layer [Ω · cm] | Dielectric breakdown | Electrostatic offset |
|---|---|---|---|
| Experiment example 2-1 | $1\times10^{5}$ | Occurred | Not occurred |
| Experiment example 2-2 | $1\times10^{6}$ | Occurred | Not occurred |
| Experiment example 2-3 | $1\times10^{7}$ | Not occurred | Not occurred |
| Experiment example 2-4 | $1\times10^{8}$ | Not occurred | Not occurred |
| Experiment example 2-5 | $1\times10^{9}$ | Not occurred | Not occurred |
| Experiment example 2-6 | $1\times10^{10}$ | Not occurred | Not occurred |
| Experiment example 2-7 | $1\times10^{11}$ | Not occurred | Not occurred |
| Experiment example 2-8 | $1\times10^{12}$ | Not occurred | Not occurred |
| Experiment example 2-9 | $1\times10^{13}$ | Not occurred | Not occurred |
| Experiment example 2-10 | $1\times10^{13.5}$ | Not occurred | Not occurred |
| Experiment example 2-11 | $1\times10^{14}$ | Not occurred | Occurred |

As illustrated in Table 2, dielectric breakdown occurred at the insulating layer 61A of each of Experiment example 2-1 having the electrically-conductive layer 61B with volume resistivity of $1.0\times10^{5}\Omega\cdot$cm and Experiment example 2-2having the electrically-conductive layer 61B with volume resistivity of $1.0\times10^{6}\Omega\cdot$cm. On the other hand, electrostatic offset was observed in Experiment example 2-11 having the electrically-conductive layer 61B with volume resistivity of $1.0\times10^{14}\Omega\cdot$cm. From the results of the evaluation of Experiment examples 2-1 to 2-11, the electrically-conductive layer 61B having volume resistivity of $10^{7}\Omega\cdot$cm or greater and $10^{13.5}\Omega\cdot$cm or less has favorable characteristics.

[Experiment Examples 3-1 to 3-23]

Further, the relationship of the volume resistance log RV1 (Ω) of the electrically-conductive layer 61B and the volume resistance log RV2 (Ω) of the fixing belt 31 as a whole with respect to the occurrence of electrostatic offset was examined. The results are illustrated in Table 3 and FIG. 6. The values of log RV1 (Ω) and log RV2 (Ω) were measured by a method in conformity to JIS K 6911. Specifically, these values were measured by bringing each sample in contact with a URS probe of a device named "Hiresta UP MCP HT450", available from Mitsubishi Chemical Analytech Co., Ltd, Kanagawa, Japan. The value of log RV1 (Ω) was measured after a voltage of 100 V was applied to the electrically-conductive layer 61B for 10 seconds. The value of log RV2 (Ω) was measured after a voltage of 1000 V was applied to the fixing belt 31 for 10 seconds.

TABLE 3

| | logRV1 [Ω] | logRV2 [Ω] | Electrostatic offset |
|---|---|---|---|
| Experiment example 3-1 | 6.90 | 12.47 | Occurred |
| Experiment example 3-2 | 6.90 | 12.58 | Occurred |
| Experiment example 3-3 | 9.11 | 12.77 | Not occurred |
| Experiment example 3-4 | 9.26 | 12.61 | Not occurred |
| Experiment example 3-5 | 11.06 | 12.73 | Not occurred |
| Experiment example 3-6 | 11.78 | 12.69 | Not occurred |
| Experiment example 3-7 | 12.80 | 13.18 | Not occurred |
| Experiment example 3-8 | 12.80 | 13.06 | Not occurred |
| Experiment example 3-9 | 12.80 | 13.20 | Not occurred |
| Experiment example 3-10 | 12.80 | 13.03 | Not occurred |
| Experiment example 3-11 | 12.80 | 13.17 | Not occurred |
| Experiment example 3-12 | 12.80 | 13.06 | Not occurred |
| Experiment example 3-13 | 12.80 | 13.17 | Not occurred |
| Experiment example 3-14 | 12.80 | 13.19 | Not occurred |
| Experiment example 3-15 | 12.80 | 13.12 | Not occurred |
| Experiment example 3-16 | 12.80 | 12.96 | Not occurred |
| Experiment example 3-17 | 12.80 | 12.95 | Not occurred |
| Experiment example 3-18 | 13.34 | 13.15 | Not occurred |
| Experiment example 3-19 | 13.34 | 13.14 | Not occurred |
| Experiment example 3-20 | 13.34 | 13.16 | Not occurred |
| Experiment example 3-21 | 14.00 | 13.37 | Occurred |
| Experiment example 3-22 | 14.00 | 13.35 | Occurred |
| Experiment example 3-23 | 14.00 | 13.27 | Occurred |

Figure 6:
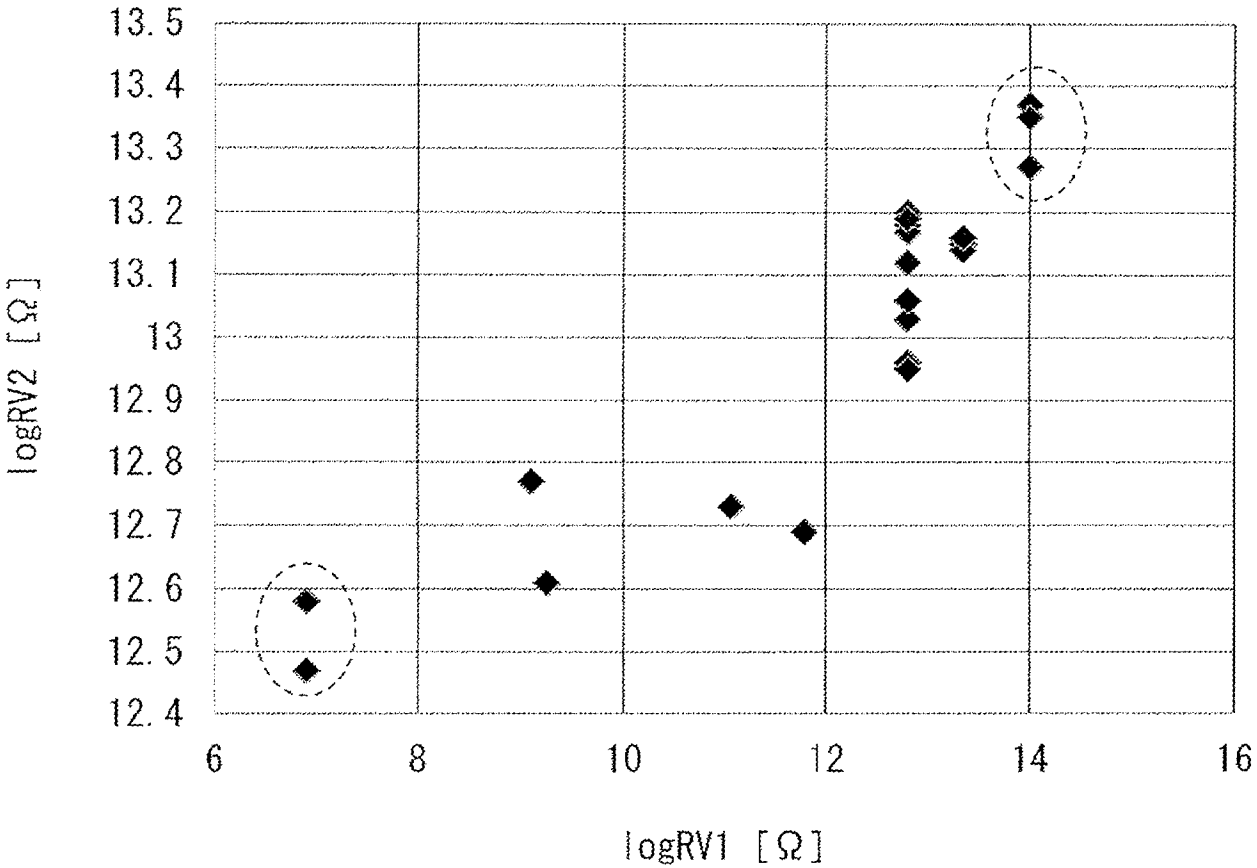
FIG. 6 is a characteristic diagram illustrating a relationship between volume resistance of an electrically-conductive layer and volume resistance of the fixing belt.

As is apparent from Table 3 and FIG. 6, electrostatic offset does not occur when the value of log RV1 is 9.11Ω or greater and 13.34Ω or less, or the value of log RV2 is 12.61Ω or greater and 13.20Ω or less (refer to Experiment examples 3-3 to 3-20). On the other hand, electrostatic offset was observed in the samples corresponding to plots surrounded by a broken line in FIG. 6 (refer to Experiment examples 3-1, 3-2, and 3-21 to 3-23). That is, electrostatic offset was observed in the case where the value of log RV1 was outside the range of 9.11Ω or greater or 13.34Ω or less, or the value of log RV2 was outside the range of 12.61Ω or greater and 13.20Ω or less. Among the samples, adhesion to the pressure-applying roller 43 of powder of a material such as the toner TN or the medium PM occurred in Experiment examples 3-1 and 3-2. In Experiment examples 3-21 to 3-23, accumulation of electric charges to the fixing belt 31 occurred, and adhesion to the fixing belt 31 of electrically-charged powder of a material such as the toner TN or the medium PM was observed.

[3. Modification Examples]

The technology has been described above referring to some example embodiments and Experiment examples. However, the technology is not limited to the example embodiments, etc. described above, and is modifiable in various ways. For example, the foregoing example embodiments have been described referring to the image forming apparatus that performs primary transfer or direct transfer; however, the technology is not limited thereto. In one alternative example embodiment, the technology is applicable to an image forming apparatus that also performs secondary transfer.

Moreover, the foregoing example embodiments, etc. have been described referring to an example using the ID unit 20 that forms a monochrome image; however, the technology is not limited thereto. In one alternative example embodiment, the image forming apparatus of the technology may have an ID unit that forms a color image.

Moreover, the foregoing example embodiments have been described referring to an example using the plate-shaped heater 38 containing a heating element, such as a resistance wire, as the heat source of the fixing section 30; however, the technology is not limited thereto. In one alternative example embodiment, a halogen lamp may be used as the heat source instead of the heater 38. Further, in one alternative example embodiment, an additional member that urges the inner circumferential surface 31A of the fixing belt 31, such as a pressure-applying pad, may also be provided to provide the nip.

Moreover, the foregoing example embodiments have been described referring to an example in which the exposure head 22 uses an LED head having a light emitting diode as a light source; however, the technology is not limited thereto. In one alternative example embodiment, an exposure head having a laser element or any other element as a light source may be used.

Figure 5:
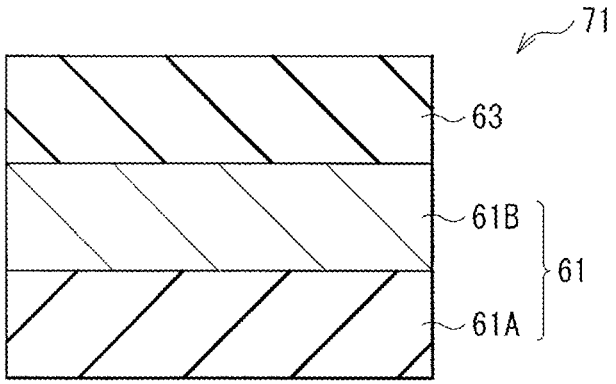
FIG. 5 is a cross-sectional view of a configuration example of a fixing belt of a modification example.

Moreover, the foregoing example embodiments have been described referring to an example using the fixing belt 31 having the elastic layer 62; however, the belt of the technology is not limited thereto. In one alternative example embodiment, as in a fixing belt 71 that is illustrated in FIG. 5 as a modification example, the releasing layer 63 may be provided on the base 61 as a second insulating layer, instead of providing the elastic layer 62.

Moreover, the foregoing example embodiments have been described referring to the image forming apparatus having a printing function as an example corresponding to the "image forming apparatus" according to one specific but non-limiting embodiment of the technology; however, the technology is not limited thereto. For example, the technology is also applicable to an image forming apparatus that serves as a multi-function peripheral having functions such as a scanner function or a facsimile function in addition to the foregoing printing function.

It is possible to achieve at least the following configurations from the above-described example embodiments of the technology.

[1]

A fixing device including a belt member that includes a first insulating layer, an electrically-conductive layer, and a second insulating layer in order, in which the following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts.

[2]

The fixing device according to [1], in which the following conditional expression (2) is further satisfied, $$12.61\Omega \leq \log RV2 \leq 13.20\Omega \quad (2)$$

where RV2 represents a volume resistance of the belt member on a condition that an applied voltage is 1000 volts.

[3]

The fixing device according to [1] or [2], in which the electrically-conductive layer has volume resistivity of about $10^7$ ohm-centimeters or greater and about $10^{13.5}$ ohm-centimeters or less.

[4]

The fixing device according to any one of [1] to [3], in which the first insulating layer has a thickness of about 10 micrometers or greater and about 100 micrometers or less.

[5]

The fixing device according to any one of [1] to [4], further including a temperature detector that detects temperature of the belt member while being in contact with the belt member.

[6]

The fixing device according to any one of [1] to [5], in which the second insulating layer includes an elastic layer.

[7]

The fixing device according to [6], in which the belt member further includes a releasing layer positioned on side, of the elastic layer, opposite to the electrically-conductive layer.

[8]

The fixing device according to any one of [1] to [7], further including a heat generating member that generates heat.

[9]

The fixing device according to [8], further including a heat transmitting member that transmits, while being in contact with the belt member, the heat generated by the heat generating member to the belt member.

[10]

The fixing device according to [9], in which the belt member includes a tubular endless belt that has an inner circumferential surface and an outer circumferential surface and that is rotatable in a first direction relative to the heat transmitting member, and the heat transmitting member is in contact with the inner circumferential surface of the endless belt.

[11]

The fixing device according to [10], further including a pressure-applying member that is allowed to be brought into contact with the outer circumferential surface of the belt member.

[12]

The fixing device according to any one of [1] to [11], in which the first insulating layer includes a base material, and the electrically-conductive layer includes the base material to which a conductive agent is added.

[13]

The fixing device according to [1], in which the second insulating layer includes a releasing layer.

[14]

An image forming apparatus including a fixing device, the fixing device including a belt member that includes a first insulating layer, an electrically-conductive layer, and a second insulating layer in order, in which the following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts.

Each of the fixing device and the image forming apparatus according to the embodiments of the technology includes the belt that has the electrically-conductive layer with a predetermined volume resistance. This structure reduces generation of electrification of the belt due to, for example, friction between a heat transmitting member and the belt.

The fixing device and the image forming apparatus according to the embodiment of the technology are suitably used to form an image with higher quality.

This effect is merely an example of the technology, and the effect of the technology is not limited to this and may include any of the effects described below.

Each of the exposure controller 55, the voltage controller 56, the motor controller 57, the fixation controller 58, and the image formation controller 59 illustrated in FIG. 4 is implementable by circuitry that includes at least one of a field programmable gate array (FPGA), a semiconductor integrated circuit, and an application specific integrated circuit (ASIC). The FPGA is an integrated circuit (IC) designed to be configured after manufacturing in order to perform all or a part of the functions of each of the exposure controller 55, the voltage controller 56, the motor controller 57, the fixation controller 58, and the image formation controller 59 illustrated in FIG. 4. The ASIC is an IC customized to perform all or a part of the functions of each of the exposure controller 55, the voltage controller 56, the motor controller 57, the fixation controller 58, and the image formation controller 59 illustrated in FIG. 4. The semiconductor integrated circuit may be, for example, at least one processor such as a central processing unit (CPU). The processor may be configurable to read instructions from at least one machine readable tangible non-transitory medium to thereby perform all or a part of functions of each of the exposure controller 55, the voltage controller 56, the motor controller 57, the fixation controller 58, and the image formation controller 59 illustrated in FIG. 4. The form of such a medium may include, for example, any type of magnetic medium, any type of optical medium, or any type of semiconductor memory (i.e., semiconductor circuit). The magnetic medium may be a hard disk, for example. The optical medium may be a CD or a DVD, for example. The semiconductor memory may be a volatile memory or a non-volatile memory, for example. The volatile memory may include a DRAM or a SRAM, for example. The nonvolatile memory may include a ROM or a NVRAM, for example.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A fixing device comprising a belt member that includes a first insulating layer, an electrically-conductive layer, and a second insulating layer in order, wherein the following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts, and wherein the fixing device further comprises a heat generating member that generates heat.

2. The fixing device according to claim 1, wherein the following conditional expression (2) is further satisfied, $$12.61\Omega \leq \log RV2 \leq 13.20\Omega \quad (2)$$

where RV2 represents a volume resistance of the belt member on a condition that an applied voltage is 1000 volts.

3. The fixing device according to claim 1, wherein the electrically-conductive layer has volume resistivity of about $10^7$ ohm-centimeters or greater and about $10^{13.5}$ ohm-centimeters or less.

4. The fixing device according to claim 1, wherein the first insulating layer has a thickness of about 10 micrometers or greater and about 100 micrometers or less.

5. The fixing device according to claim 1, further comprising a temperature detector that detects temperature of the belt member while being in contact with the belt member.

6. The fixing device according to claim 1, further comprising a heat transmitting member that transmits, while being in contact with the belt member, the heat generated by the heat generating member to the belt member.

7. The fixing device according to claim 6, wherein the belt member comprises a tubular endless belt that has an inner circumferential surface and an outer circumferential surface and that is rotatable in a first direction relative to the heat transmitting member, and the heat transmitting member is in contact with the inner circumferential surface of the endless belt.

8. The fixing device according to claim 7, further comprising a pressure-applying member that is allowed to be brought into contact with the outer circumferential surface of the belt member.

9. The fixing device according to claim 1, wherein the first insulating layer includes a base material, and the electrically-conductive layer includes the base material to which a conductive agent is added.

10. An image forming apparatus comprising the fixing device according to claim 1.

11. A fixing device comprising a belt member that includes a first insulating layer, an electrically-conductive layer, and a second insulating layer in order, wherein the following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts, and wherein the second insulating layer comprises an elastic layer.

12. The fixing device according to claim 11, wherein the belt member further includes a releasing layer positioned on a side, of the elastic layer, opposite to the electrically-conductive layer.

13. A fixing device comprising a belt member that includes a first insulating layer, an electrically-conductive layer, and a second insulating layer in order, wherein the following conditional expression (1) is satisfied, $$9.11\Omega \leq \log RV1 \leq 13.34\Omega \quad (1)$$

where RV1 represents a volume resistance of the electrically-conductive layer on a condition that an applied voltage is 100 volts, and wherein the second insulating layer comprises a releasing layer.

* * * * *